US005177846A

United States Patent [19]

Bryant

[11] Patent Number: 5,177,846

[45] Date of Patent: Jan. 12, 1993

[54] INSERTION TOOL

[76] Inventor: Gilbert A. Bryant, 8914 Nelson Way, Escondido, Calif. 92026

[21] Appl. No.: 807,500

[22] Filed: Dec. 16, 1991

[51] Int. Cl.[5] ..... B25G 3/02

[52] U.S. Cl. ..... 29/237; 29/278

[58] Field of Search ..... 279/41 R; 29/270, 278, 29/280, 281.1

[56] References Cited

U.S. PATENT DOCUMENTS

| | | | |
|---|---|---|---|
| 2,669,772 | 2/1954 | Hamler | 29/270 |
| 3,074,155 | 1/1963 | Cootes et al. | 29/278 |
| 3,815,831 | 6/1974 | Jooste . | |
| 3,885,743 | 5/1975 | Wake . | |
| 4,512,071 | 4/1985 | Fieberg et al. | 29/278 |
| 4,522,339 | 6/1985 | Costa . | |
| 4,561,159 | 12/1985 | Schuster | 29/275 |

*Primary Examiner*—Robert C. Watson
*Attorney, Agent, or Firm*—James G. O'Neill

[57] ABSTRACT

A hand held insertion tool formed from a single piece of material, having a comfortable gripping portion and an irrigation fitting holding portion, with the fitting holding portion including an elongated hollow central portion and a pair of stepped, slotted openings along one side thereof for releasably holding a fitting therein, to accurately place and then inserting said fitting into a water supply means.

6 Claims, 1 Drawing Sheet

FIG. 1
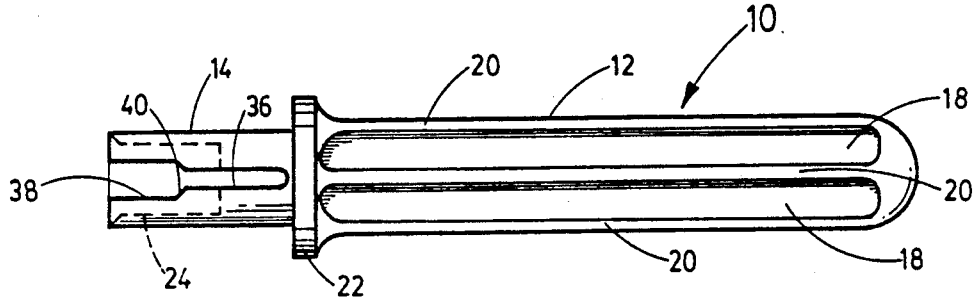
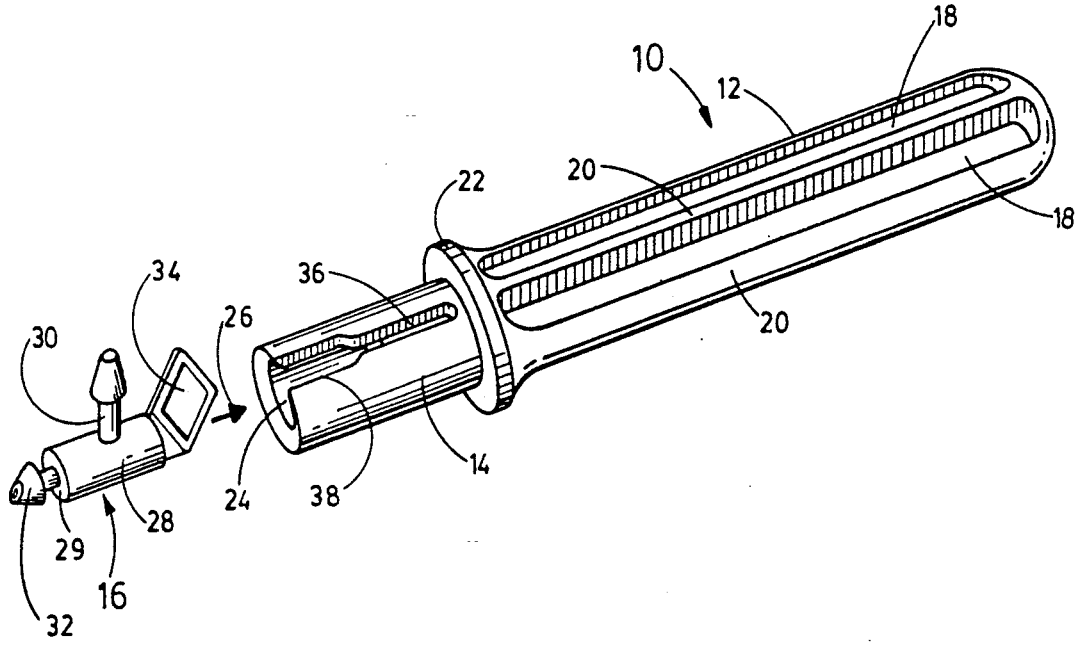
FIG. 2

INSERTION TOOL

BACKGROUND OF THE INVENTION

1. Field of the Invention

This invention relates generally to tools and more particularly to an insertion tool for fittings or sprinkler heads used in irrigation systems.

2. Description of Related Art

Irrigation systems, particularly drip emitter irrigation systems have become increasingly more popular over the years because of their water savings potential, in arid or water short parts of the world. These drip and other irrigation systems require that fittings or sprinkler heads be inserted into the conduit, hose, pipe or the like, which is used to carry water in the system, at specific locations, depending on how and where the irrigation systems are used. The exact location of the fittings or sprinkler heads on the water carrying hose is very important, to ensure that the items to be watered, such as plants, trees and vines, receive the required amount of moisture. Therefore, to aid in the accurate insertion of irrigation fittings into various systems, insertion means, including specific tools have been developed and used. Again, these known irrigation systems and fitting insertion means may take a variety of forms, usually limited to or dependant upon the specific application and/or system being used.

One type of drip emitter system that is now widely used, because of, among other things, its low flow rate and adjustable flow control features, is that disclosed in U.S. Pat. No. 3,885,743. The disclosure of this U.S. Pat. No. 3,885,743 is incorporated herein, in its entirety, by this reference thereto. The particular flow control devices or fittings disclosed in this patent have substantially frustroconical heads, with sharpened end points, that may be forced through the sidewall of a conduit or supply hose made from flexible material. However, it has been found that problems arise in attempting to accurately place and then try to force these flow control devices through the sidewalls of hoses when only using one's fingers, or any currently available or known tool, such as a pair of pliers. Therefore, their exists an urgent need in the art, particularly for installers or users of such drip irrigation systems, for an easily manufactured tool that may be conveniently used to quickly and expeditiously insert fittings, in desired locations, in a drip irrigation system.

Although some tools for inserting flow control devices are known, they usually consist of a wrench or the like to thread a fitting into a hole formed in a water carrying conduit or pipeline. One such prior art tool is shown in U.S. Pat. No. 3,815,831, which discloses a tee shaped tool having a free end of its stem formed into a socket with a hexagonal formation and an extension to receive a sprinkler head. The cross bar of the tee has a sharpened end or spike that is used to form holes into which sprinkler heads are first inserted and then screwed into position by the socket of the tee. This tool, however, is limited in its application or use to the specific sprinkler heads disclosed in this patent, and cannot be modified for use with flow control devices or fittings of other systems which do not have hexagonal heads and threaded bodies.

U.S. Pat. No. 4,522,339, discloses a further tool for inserting fittings into an irrigation system and includes a pair of elongated tongs which are used as pinchers to hold and to force a fitting, having a piercing point, into a water carrying conduit. However, the tool of this patent is awkward to use and is also only useful for inserting the specifically shaped fittings disclosed in this patent, and is not adapted to be modified for use with other fittings, not having the same shape.

While the foregoing described prior art devices have provided some limited improvements and overcome some of the problems encountered when trying to insert fittings into irrigation systems, they are limited in application, and are too complex or expensive to manufacture for use in other situations. Therefore, after many attempts to solve the problems of devising an insertion tool which may be cheaply and easily manufactured for use in connection with the accurate insertion of irrigation fittings into a water carrying conduit or hose, in various settings and under different working conditions, there still exists the need for a simple, easy to transport and use, low-cost insertion tool for irrigation fittings.

SUMMARY OF THE INVENTION

Accordingly, it is a general object of the present invention to provide an improved insertion tool. It is a particular object of the present invention to provide an improved insertion tool for use with fittings for a drip emitter system. It is a still more particular object of the present invention to provide an insertion tool for irrigation fittings which is both low in cost to manufacture and easy to use in all working conditions for accurately inserting irrigation fittings. And, it is yet a further object of the present invention to provide an improved insertion tool for irrigation fittings which may be easily changed for use with different size or type fittings.

In accordance with one aspect of the present invention, there is provided a hand held insertion tool having a comfortable gripping portion and an integral irrigation fitting holding portion, which fitting holding portion includes an elongated hollow central portion and a pair of stepped, slotted openings along one side thereof for releasably holding a fitting therein for accurately placing and then inserting said fitting into a water supply means.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

FIG. 1 is a side elevational view of the insertion tool of the present invention; and FIG. 2 is a perspective view of the insertion tool of FIG. 1, further showing an irrigation fitting that may be inserted and releasably held in the insertion tool for insertion into a water supply means.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for the general description of an improved hand held insertion tool 10. The tool 10 is preferably constructed by known fabrication techniques so as to have a one piece or unitary body, with a gripping or handle end 12 and an integrally formed irrigation fitting holding end 14. Although it is to be understood that the tool 10 may be easily adapted or modified to hold and insert various types and sizes of irrigation fittings, it is described herein for use in connection with the holding and insertion of fittings or flow control devices 16, of the type more specifically described in U.S. Pat. No. 3,885,743, referred to above.

The tool 10 may be made in any desired shape, from any available material, by any known fabrication method, but is preferably molded from plastic so as to be substantially circular in cross section, in as cheap a manner as possible. The handle 12 is preferably substantially circular in cross section with a plurality of grooves and ridges 18, 20, around its periphery for fitting comfortably into the hand of a user. An enlarged flange or rim 22 is integrally formed between the end of the gripping portion 12 and the fitting holding portion 14. In this manner, a user may firmly grip the handle 12 of tool 10 so as to be better able to both push (along the long axis of the tool) and, if required or desired, rotate the tool, and thus a fitting held in the holding portion 14, when inserting fittings 16 into a water supply means (not shown) having resilient or similar walls that may be pierced by a fitting, in a manner understood by those skilled in the art.

The fitting holding end 14 may also be formed in any desired manner and in any desired shaped, but is preferably formed or molded at the same time as and integrally with the gripping or handle end 12. This holding end 14 is also preferably substantially circular in cross section with an internally formed hollow, substantially circular cavity or opening 24 of a predetermined size, into which a fitting, such as 16 may be inserted (in the direction of the arrow 26 shown in FIG. 2) and removably held in position. The fitting 16 includes a cylindrical body 28 ending in a shoulder 29, a frustroconical head 32 terminating at a sharpened or pointed end, for insertion into a water supply means having a wall penetrable by said head, and a handle 34. An outlet tube 30 is fixed to and extends outwardly from the cylindrical body 28 for holding a local water supply tube thereon. When a fitting 16 is inserted into the holding end 14, the cylindrical body 28 fits snugly in the cavity 24, with the handle 34 fitting into and captured in a first, smaller slot 36, and the outlet tube 30 fitting into and captured in a second, stepped up or larger slot 38. The slots 36 and 38 are in reality merely different size sections of a single slot, that is formed on the exterior surface of the holding end 14 and connected to the interior cavity 24, as shown in the drawings.

The fitting 16 is preferably pressed into or inserted into the holding end 14 of the tool 10, as explained above, until the outlet tube 30 contacts a pair of shoulders 40 formed between the larger slot 38 and the smaller slot 36. When removably held within the holding portion 14, the fitting 16 will be prevented from rotation, relative to the tool 10, by contact of the outlet tube 30 against the walls of larger slot 38 and the handle 34 against the walls of smaller slot 36.

In use, the tool 10 has fittings, such as 16, inserted in the holding end 12. The tool 10 is then gripped in the hand of a user by the handle 14, and the frustroconical sharpened head 32 of a fitting is then accurately aligned with a desired position on a water supply means having walls of the type which may be penetrated by the head 32. The fitting 16 may then have its head 32 easily inserted or pushed into the chosen position on the water supply means by the user forcefully pressing the entire tool against this water supply means until the sharpened end penetrates the wall of the water supply means. The user will only have to press the tool and thus the fitting into the water supply means until the shoulder 29 of the fitting contacts the outside surface of the water supply means. The tool 10 is then withdrawn, leaving the head of the fitting fixed in the water supply means, with the entire fitting, therefore, in its desired position for use to bring moisture to a plant, or the like. The tool may then be used to insert other fittings in selected positions in the same water supply means or to insert similar fittings into other water supply means.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A hand held tool for inserting fittings into a conduit of an irrigation system comprising, in combination:

a one piece elongated body having an exterior surface and two ends;

said elongated body being circular in cross section and including a handle portion at one end and a fitting holding portion formed integrally therewith at the other end thereof;

said handle portion including a plurality of grooves and ridges formed on said exterior surface thereof for gripping by the hand of a user, and a flange on said exterior surface adjacent said fitting holding portion of said tool;

said fitting holding portion including a hollow cavity formed interiorly of and extending along an axis of said elongated body, said hollow cavity opening to the exterior surface thereof and said other end;

a slot formed in said holding portion, connected to said hollow cavity by passing through the exterior surface of said body, and connected to said open other end;

said slot in said fitting holding portion including first and second sections having continuous substantially parallel sides, with said first section being smaller in width than said second section, with said second, larger section of said slot opening to said open other end of said elongated boy and including a single pair of shoulders formed therein between said first and second sections; and a hollow cavity of said holding portion section adapted to receive a fitting inserted into said hollow cavity, along said axis of said elongated body, through said open other end, whereby said fitting may be removably held in said hollow cavity and forcefully inserted into a water supply means for an irrigation system by said tool, and said too easily withdrawn from said inserted fitting, by pulling said tool along said axis of said elongated body.

2. The hand held fitting insertion tool of claim 1 wherein said tool is molded from plastic.

3. A hand held insertion tool for forcing fittings into a conduit of an irrigation system comprising, in combination:

an elongated substantially circular body having an exterior surface and two ends;

a substantially circular handle portion formed at one end of said body and a substantially circular fitting holding portion formed at the other end thereof;

said handle portion including a plurality of grooves and ridges formed on said exterior surface thereof for gripping by the hand of a user, and a substantially circular flange formed on said exterior surface adjacent said fitting holding portion of said tool;

said fitting holding portion including a substantially circular, hollow cavity formed interiorly of said substantially circular elongated body extending along an axis thereof, and opening to the exterior surface thereof and to said other end;

a slot formed in said fitting holding portion connected to said hollow cavity by passing through the exterior surface of said body, and connected to said open other end; said slot in said fitting holding portion including first and second sections having continuous substantially parallel sides, with said first section being smaller in width than said second section, and wherein said second, larger section of said slot includes a single pair of shoulders formed therein between said first and second sections, adapted to receive and hold an outwardly extending portion of said fitting; and said first, smaller section thereof is adapted to receive and hold a further outwardly extending portion of said fitting; said slot preventing relative rotation of said fitting with respect to said tool when said fitting is held in said tool; and said substantially circular, hollow cavity is adapted to receive and removably hold the cylindrical body of an irrigation fitting inserted therein along said axis of said elongated body through said open other end, whereby said fitting may be removably held in said hollow cavity and forcefully inserted into said conduit by said tool and said tool removed from said inserted fitting by withdrawing said tool, along said axis of said elongated body.

4. The hand held fitting insertion tool of claim 3 wherein said tool is molded in one piece from plastic.

5. A hand held insertion tool for forcing fittings into a water supply system for an irrigation system comprising, in combination:

a one piece, elongated, substantially circular body having an exterior surface and two ends;

a substantially circular handle portion formed at one end of said body and a substantially circular fitting holding portion formed at the other end thereof;

said handle portion being solid and including a plurality of grooves and ridges formed on said exterior surface thereof for gripping by the hand of a user, and a substantially circular flange formed on said exterior surface adjacent said fitting holding portion of said tool;

said fitting holding portion including a substantially circular, hollow cavity formed interiorly of said substantially circular elongated body and extending along an axis thereof, with an opening to the exterior surface thereof at said other end;

said substantially circular, hollow cavity adapted to receive and removably hold the cylindrical body of an irrigation fitting inserted therein through said open other end; and said opening to said exterior surface and said open other end comprising a slot having first and second sections formed in said fitting holding portion connected to said hollow cavity by passing through the exterior surface of said body and connected to said open other end; said first section of said slot being smaller in width than said second section, with each of said first and second sections of said slot having continuous substantially parallel sides, and a single pair of shoulders formed in said slot between said first and second sections with said second section being connected to said open other end; said first, smaller section adapted to receive and hold an outwardly extending portion of said fitting; and said second, larger section adapted to receive and hold a further outwardly extending portion of said fitting inserted therein through said open other end; said substantially parallel sides of said first and second sections of said slot preventing relative rotation of said fitting with respect to said tool when said fitting is held in said tool, whereby said fitting may be forcefully inserted into said water supply means for irrigation system by said tool and said tool withdrawn from said inserted fitting by pulling along said axis of said elongated body.

6. The hand held fitting insertion tool of claim 5 wherein said tool is molded from plastic.

* * * * *